US006585180B2

(12) United States Patent
Inoue

(10) Patent No.: US 6,585,180 B2
(45) Date of Patent: Jul. 1, 2003

(54) PIPELINE BEADS MILL AND DISPERSING SYSTEM HAVING THE PIPELINE BEADS MILL

(75) Inventor: Masakazu Inoue, Tokyo (JP)

(73) Assignee: Inoue Mfg., Inc. (JP)

( * ) Notice: Subject to any disclaimer, the term of this patent is extended or adjusted under 35 U.S.C. 154(b) by 25 days.

(21) Appl. No.: 09/854,295

(22) Filed: May 11, 2001

(65) Prior Publication Data

US 2001/0042803 A1 Nov. 22, 2001

(30) Foreign Application Priority Data

May 18, 2000 (JP) ..... 2000-146784

(51) Int. Cl.[7] ..... B02C 18/16
(52) U.S. Cl. ..... 241/171; 241/172
(58) Field of Search ..... 241/171, 172, 241/101.8

(56) References Cited

U.S. PATENT DOCUMENTS 4,856,717 A 8/1989 Kamiwano et al.
4,919,347 A 4/1990 Kamiwano et al.

*Primary Examiner*—Mark Rosenbaum
(74) *Attorney, Agent, or Firm*—Adams & Wilks

(57) ABSTRACT

A pipeline beads mill has a dispersion chamber, a first feeding port for feeding a material to be treated into the dispersion chamber, a second feeding port for feeding a dispersion media into the dispersion chamber, a tubular outer stator disposed in the dispersion chamber, and a tubular inner stator disposed in the outer stator in spaced-apart relation thereto to form a treatment gap therebetween for receiving the dispersion media and the material to be treated. The inner stator has an outflow port in communication with the treatment gap. A tubular rotor is disposed in the dispersion chamber and partitions the treatment gap into an outer gap portion and an inner gap portion. A rotationally driven shaft rotates the rotor to displace the dispersion media so as to disperse the material to be treated. The rotor has a circulation port for permitting circulation of dispersion media between the outer gap portion and the inner gap portion of the treatment gap during rotation of the drive rotor. A discharge port is disposed in communication with the outflow port of the inner stator for discharging the dispersed material. A separating member is disposed at an inner side of the outflow port of the inner stator for separating the dispersion media from the dispersed material and permitting the dispersed material but not the dispersion media to be discharged from the discharge port of the dispersion chamber.

27 Claims, 4 Drawing Sheets

PIPELINE BEADS MILL AND DISPERSING SYSTEM HAVING THE PIPELINE BEADS MILL

BACKGROUND OF THE INVENTION

1. Field of the Invention

The present invention relates to a pipeline beads mill for use as an independent dispersing apparatus for dispersing a material to be treated, such as a slurry or mill base in which solid particles are suspended in a liquid, or for use in a feeding line for preliminary dispersion treatment of the material to be treated prior to dispersion of the material by a dispersing apparatus. The present invention also relates to a dispersing system having the pipeline beads mill.

2. Background Information

In the chemical field, various products, such as coating materials, printing inks, pigments and magnetic materials, are produced using a stirring treatment. In the case of materials to be treated having high viscosity, as well as materials (e.g., a slurry) having low or medium viscosity, a relatively large power is required for conducting a uniform stirring treatment. Particularly, in the case in which a dispersing apparatus, such as, for example, a wet-type medium-dispersing apparatus, is used to finely grind a material to be treated by stirring it together with a dispersion medium, such as beads, a pre-treatment (pre-mixing) operation which involves preliminarily stirring the material to be treated is conducted before feeding the material to be treated to the dispersing apparatus. It is commonly known that if the material to be treated is simply stirred in such pre-treatment operation, primary particles can hardly be formed from solids (e.g., powder) and a large amount of secondary agglomerates is deposited in the pipelines. Such deposit of secondary agglomerates has a large negative influence in the cleaning property of the pipelines and has caused contamination problems.

Further, by the presence of a large amount of secondary agglomerates as mentioned above, when the dispersion treatment is carried out using a wet-type medium-dispersing apparatus or the like, it takes a long period of time for dispersion to finely grind the material to a desired particle size. In addition, the secondary agglomerates tend to cause clogging of a screen or the like disposed in the medium-dispersing apparatus for the purpose of separating the dispersion media, such as beads, from the material to be treated, thereby deteriorating the operation efficiency of the dispersing apparatus.

SUMMARY OF THE INVENTION

It is an object of the present invention to provide a pipeline beads mill by which when a material to be treated, such as a slurry, is subjected to dispersion treatment with a dispersing apparatus, such as a wet-type medium-dispersing apparatus, secondary agglomerates are disintegrated for preliminary dispersion during the passage of the material to be treated in a feeding line.

It is another object of the present invention to provide a pipeline beads mill which efficiently disintegrates secondary agglomerates in a material to be treated prior to feeding the material to be treated into a dispersing apparatus, thereby reducing the time and power required by the dispersing apparatus to disperse the material to be treated.

It is another object of the present invention to provide a pipeline beads mill which can be used as an independent dispersing apparatus for dispersing a material to be treated.

It is another object of the present invention to provide a pipeline beads mill which is compact and which can be easily connected to and disconnected from a feeding line of a material to be treated for repair and cleaning operations.

It is yet another object of the present invention to provide a dispersing system utilizing a pipeline beads mill for subjecting a material to be treated to a preliminary dispersion treatment prior to dispersion of the material to be treated by a dispersing apparatus.

The foregoing and other objects of the present invention are carried out by a pipeline beads mill comprising a dispersion chamber, a first feeding port for feeding a material to be treated into the dispersion chamber, a second feeding port for feeding a dispersion media into the dispersion chamber, a tubular outer stator disposed in the dispersion chamber, and a tubular inner stator disposed in the outer stator in spaced-apart relation thereto to form a treatment gap therebetween for receiving the dispersion media and the material to be treated. The inner stator has an outflow port in communication with the treatment gap. A tubular rotor is disposed in the dispersion chamber and partitions the treatment gap into an outer gap portion and an inner gap portion. A rotational drive shaft rotates the rotor to displace the dispersion media so as to disperse the material to be treated. The rotor has a circulation port for permitting circulation of dispersion media between the outer gap portion and the inner gap portion of the treatment gap during rotation of the drive rotor. A discharge port is disposed in communication with the outflow port of the inner stator for discharging the dispersed material. A separating member is disposed at an inner side of the outflow port of the inner stator for separating the dispersion media from the dispersed material and permitting the dispersed material but not the dispersion media to be discharged from the discharge port of the dispersion chamber.

Preferably, axial flow blades are disposed on the rotational drive shaft for generating an axial flow to direct the material to be treated from the first feeding port to the discharge port. A flow-control surface (e.g., a non-flat surface, a projection, or a spiral groove) is preferably formed on at least one of the outer and inner surfaces of the rotor, an inner surface of the outer stator and an outer surface of the inner stator which are disposed in confronting relation to the treatment gap. In an alternative embodiment, the outer and inner surfaces of the rotor, the inner surface of the outer stator and the outer surface of the inner stator are disposed in confronting relation to the treatment gap and comprise generally flat and smooth surfaces.

Preferably, the rotor has a generally conical-shaped upper surface portion. A tubular main body of the pipeline beads mill has an inwardly projecting portion disposed over the upper surface portion of the rotor and forms an inflow port in communication with the dispersion chamber. A generally conical-shaped gap is disposed between the inwardly projecting portion and the upper surface portion of the rotor and in communication with the outer gap portion of the treatment gap. An outflow-preventing projection is preferably formed on at least one of the upper surface portion of the rotor and an inner surface of the inwardly projecting portion disposed in confronting relation to the conical-shaped gap for preventing the outflow of dispersion media through the inflow port.

In another aspect, the present invention is directed to a dispersing system having a stirring tank for stirring a material to be treated. The stirring tank has an inlet port and an outlet port. A dispersing apparatus is connected to the stirring tank for dispersing the material to be treated in a dispersion chamber by displacing dispersion media disposed in the dispersion chamber and in contact with the material to be treated. The dispersing apparatus has an inlet port for feeding the material to be treated into the dispersion chamber and an outlet port for discharging the material to be treated after dispersal thereof. A pipeline beads mill is disposed between the stirring tank and the dispersing apparatus for preliminarily dispersing the material to be treated after the material is stirred in the stirring tank but prior to dispersion of the material by the dispersing apparatus. The pipeline beads mill has a dispersion chamber, a first feeding port for feeding a material to be treated into the dispersion chamber, a second feeding port for feeding a dispersion media into the dispersion chamber, a tubular outer stator disposed in the dispersion chamber, and a tubular inner stator disposed in the outer stator in spaced-apart relation thereto to form a treatment gap therebetween for receiving the dispersion media and the material to be treated. The inner stator has an outflow port in communication with the treatment gap. A tubular rotor is disposed in the dispersion chamber so that the treatment gap is partitioned into an outer gap portion and an inner gap portion. A rotational drive shaft rotates the rotor to displace the dispersion media so as to disperse the material to be treated. A discharge port is disposed in communication with the outflow port of the inner stator for discharging the dispersed material. A separating member is disposed at an inner side of the outflow port of the inner stator for separating the dispersion media from the dispersed material and permitting the dispersed material but not the dispersion media to be discharged from the discharge port of the dispersion chamber.

Preferably, a particle size of the dispersion media contained in the treatment gap of the pipeline beads mill is from 2 to 4 times greater than a particle size of the dispersion media contained in the dispersion chamber of the dispersion apparatus.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings:

FIG. 3(A) illustrates the case where projecting portions are disposed on an outer surface of the rotor, FIG. 3(B) illustrates the case where projecting portions are disposed on the outer surface of the rotor and an outer surface of the inner stator, and FIG. 3(C) is a view illustrating the case where projecting portions are disposed on inner and outer surfaces of the rotor, the outer surface of the inner stator, and an inner surface of the outer stator; FIG. 4(A) illustrates the case where the pipeline beads mill of the present invention is disposed between a pump and a wet-type medium-dispersing apparatus, FIG. 4(B) illustrates the case where the pipeline beads mill of the present invention is disposed in a pipeline through which a slurry is circulated to a stirring tank, and FIG. 4(C) illustrates the case where a dispersion line of a conventional wet-type medium-dispersing apparatus is installed after the apparatus of FIG. 4(B).

DETAILED DESCRIPTION OF THE PREFERRED EMBODIMENTS

While this invention is susceptible of embodiments in many different forms, this specification and the accompanying drawings disclose examples of the use of the invention. The invention is not intended to be limited to the embodiments so described, and the scope of the invention will be pointed out in the appended claims.

Figure 1:
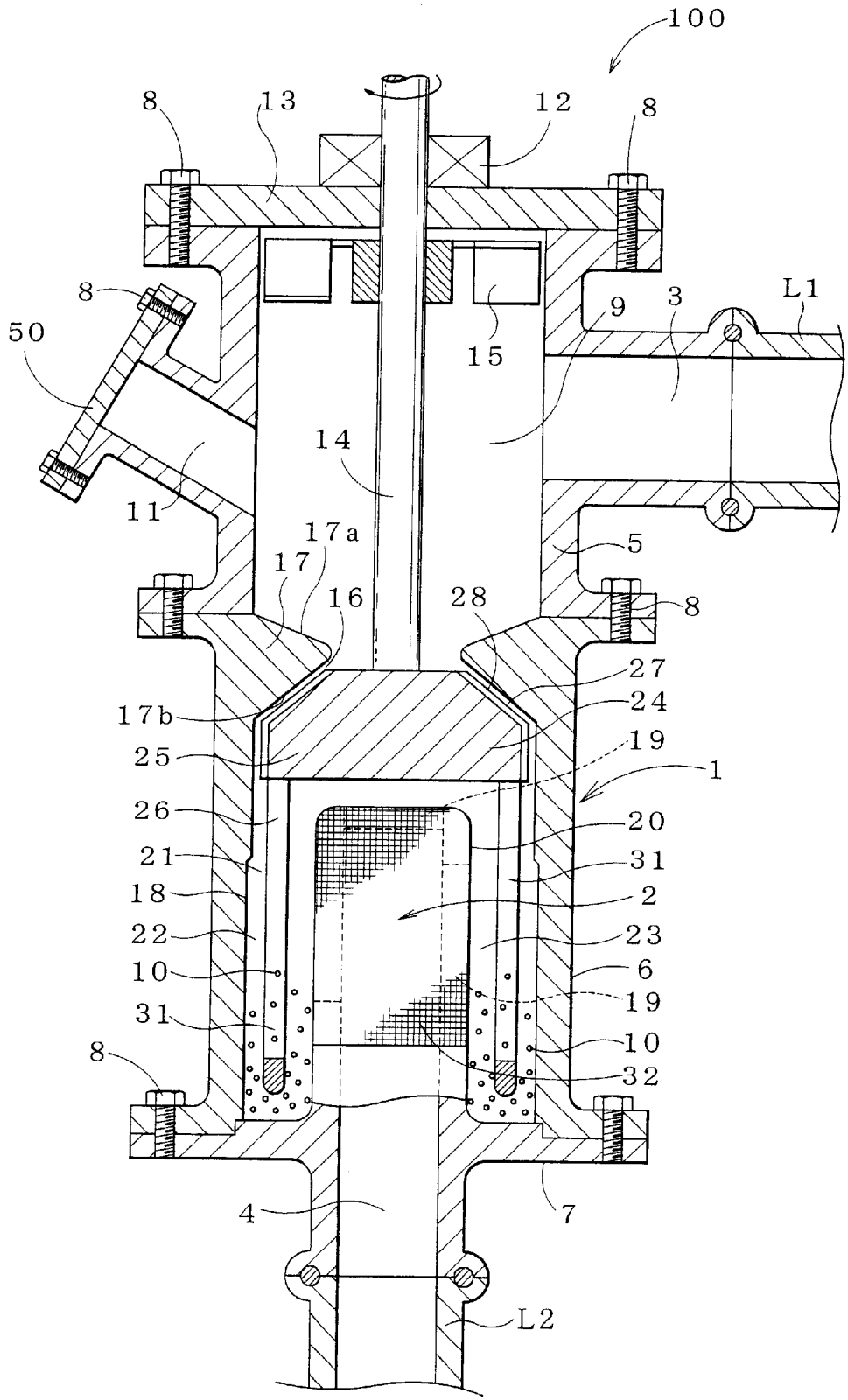
FIG. 1 is sectional view showing an embodiment of a pipeline beads mill according to the present invention.
Figure 2:
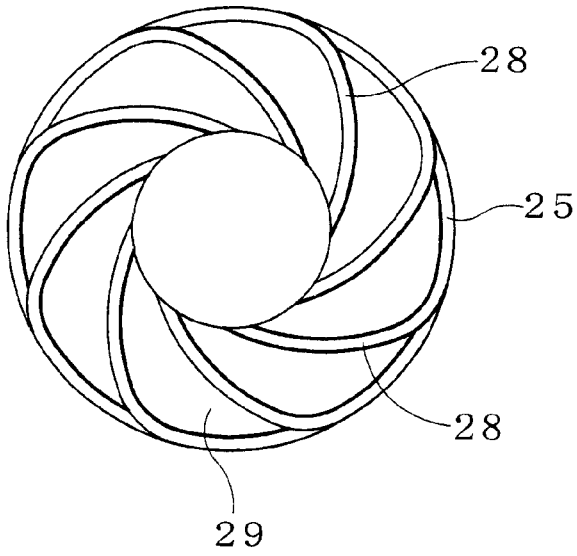
FIG. 2(A) is a top view and FIG. 2(B) is a front view of an upper portion of a rotor of a pipeline beads mill according to the present invention.
Figure 2:
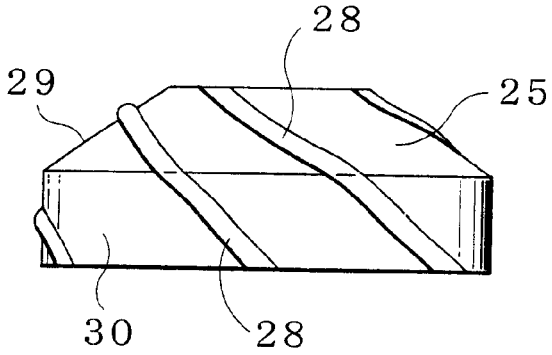

Referring now to the drawings in detail, wherein like numerals are used to indicate like elements throughout, there is shown in FIGS. 1, 2A and 2B an embodiment of pipeline beads mill, generally designated at 100, according to the present invention. The pipeline beads mill 100 has a main body, generally designated at 1, formed of a first tubular member 5, a second tubular member 6, and a third tubular member 7. The main body 1 has a dispersion chamber generally designated at 2, a first feeding port 3 connected to a pipeline L1 for feeding a material to be treated (not shown), such as a slurry or mill base, into the dispersion chamber 2, and a second feeding port 11 for feeding a dispersion media 10, such as beads, into the dispersion chamber 2. As further described below, the material to be treated is ground and dispersed in the dispersion chamber 2 using the dispersion media 10. A discharge port 4 is connected to a pipeline L2 for discharging the dispersed material.

The first tubular member 5 of the main body 1 has the first feeding port 3, the second feeding port 11, and an inflow chamber 9 through which the material to be treated flows prior to flowing into the dispersion chamber 2. A cover member 50 is removably connected to the first tubular member 5 using suitable connecting members (e.g., bolts 8) to close the second feeding port 11 during operation of the pipeline beads mill. A rotary drive shaft 14 rotationally driven by a motor (not shown) extends into the first tubular member 5 through an axial sealing portion 12 and a cover plate 13. The third tubular member 7 has the discharge port 4 extending through a central portion thereof. The second tubular member 6 has the dispersion chamber 2 and is disposed between the first and third tubular members 5, 7. The first, second and third tubular members 5–7 are connected together using suitable connecting means, such as bolts 8.

A plurality of axial flow blades 15 are mounted on the drive shaft 14 for rotation therewith. The axial flow blades 15 are mounted on the drive shaft 14 so that the material to be treated which flows in the inflow chamber 9 will flow in an axial direction through the second tubular member 6 and toward the discharge port 4. Preferably, as shown in FIG. 1, the axial flow blades 15 comprise paddle-type blades which function to paddle the material to be treated in the inflow chamber 9 down toward the second tubular member 6. In an alternative embodiment, axial-flow propellers may be used as the axial flow blades 15 instead of paddle-type blades.

The second tubular member 6 has an annular projecting portion 17 which projects inwardly from an upper portion toward a center of the second tubular member 6. The projecting portion 17 has a surface 17*a* which slants inwardly and downward toward the center of the second tubular member 6, and a surface 17*b* which slants outwardly and downward and away from the center of the second tubular member 6 in an inverted conical shape to form an inflow port 16.

A tubular outer stator 18 is disposed in the dispersion chamber 2 at a lower portion of the second tubular member 6. A tubular inner stator 20 is disposed in the outer stator 18 and has an outflow port 19 in communication with the discharge port 4. The outer stator 18 and the inner stator 20 are disposed in spaced-apart relation to form an annular treatment gap 21 therebetween for receiving the dispersion media 10 and having an open end and a closed end. In the embodiments shown in FIGS. 1 and 3A–3C, the tubular outer and inner stators 18, 20 are generally cylindrical-shaped. It is understood by those of ordinary skill in the art, however, that other shapes, such as any one of several polygonal tubular shapes, are suitable for the outer and inner stators 18, 20.

A tubular rotor 24 extends into the dispersion chamber 2 from the open end of the treatment gap 21 so that the treatment gap 21 is partitioned into an outer gap portion 22 and an inner gap portion 23 which communicates with the outer gap portion 22 at the closed end of the treatment gap 21. The rotor 24 has an upper portion 25 having a generally truncated conical shape disposed at a lower end of the drive shaft 14, and a tubular main body portion 26 connected to the upper portion 25 and extending into the treatment gap 21. The rotor 24 is connected to the drive shaft 14 for rotation therewith. The width of the treatment gap 21, and particularly the width of the outer gap portion 22, is preferably selected and adjusted to be the same as the width of a treatment gap in a conventional annular-type medium-dispersing apparatus so that by the rotation of the rotor 24, the dispersion media 10 in the treatment gap 21 is displaced or agitated to efficiently exert sufficient shearing forces to, and thereby disperse, the material to be treated.

A generally conical-shaped gap 27 in communication with the outer gap portion 22 of the treatment gap 21 is disposed between the upper portion 25 of the rotor 24 and the projecting portion 17 of the second tubular member 6. A plurality of outflow-preventing projections 28 are preferably disposed on an outer surface of the upper portion 25 of the rotor 24 for preventing the dispersion media from passing through the gap 27 and flowing out of the inflow port 16 and into the inflow chamber 9 of the first tubular member 5. In an alternative embodiment, the outflow-preventing projections 28 may be formed on the inner surface of the projecting portion 17 instead of the outer surface of the upper portion 25 of the rotor 24. In yet another alternative embodiment, the outflow-preventing projections 28 may be formed on both the inner surface of the projecting portion 17 and the outer surface of the upper portion 25 of the rotor 24.

FIG. 2(A) is a top view and FIG. 2(B) is a front view of an embodiment of the upper portion 25 of the rotor 24 according to the present invention. In this embodiment, the outflow-preventing projections 28 project spirally from a generally conical-shaped surface portion 29 and a generally cylindrical-shaped portion 30 of the upper portion 25 of the rotor 24. By this construction, when the rotor 24 is rotated, movement of the dispersion media 10 toward the gap 27 is prevented by the outflow-preventing projections 28 and returned to the treatment gap 21. In an alternative embodiment, spiral grooves or projections providing a paddling-down effect may be provided on the upper portion 25 of the rotor 24 instead of the outflow-preventing projections 28.

When the rotor 24 is rotated, the dispersion media 10 is agitated and flows in the treatment gap 21. A circulation port 31 is formed in the rotor 24 so that the dispersion media 10 which passes through the outer gap portion 22 of the treatment gap 21 and flows into the inner gap portion 23 of the treatment gap 21 will be returned to the outer gap portion 22 from the inner gap portion 23. In the embodiment shown in FIG. 1, the circulation port 31 preferably comprises two long slots extending axially along the periphery of the main body 26 of the rotor 24. It is understood, however, that the specific configuration and location of the circulation port 31 may be varied so long as the dispersion media 10 is permitted to circulate in the outer and inner gap portions 22, 23 of the treatment gap 21.

Figure 3:
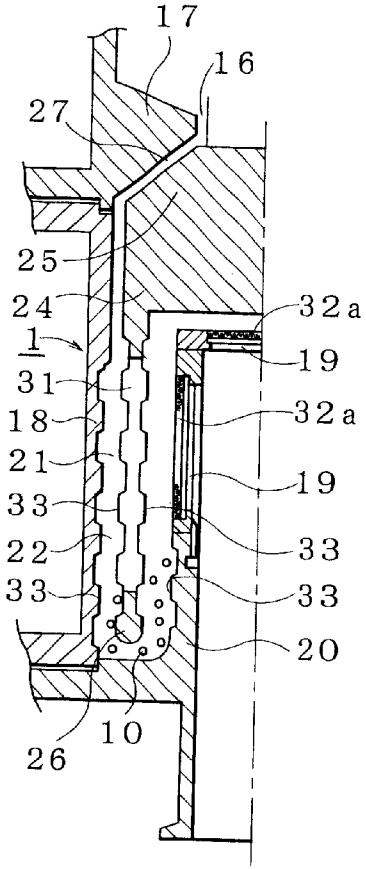
FIGS. 3(A), 3(B) and 3(C) are cross-sectional views showing flow-control surfaces disposed on a rotor, an outer stator and/or an inner stator, where
Figure 3:
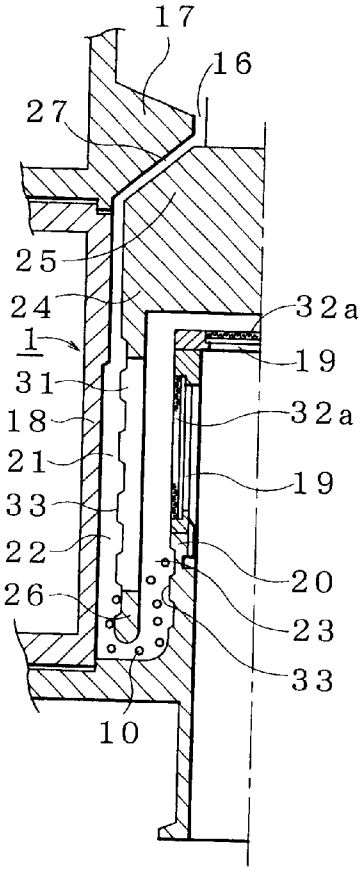
Figure 3:
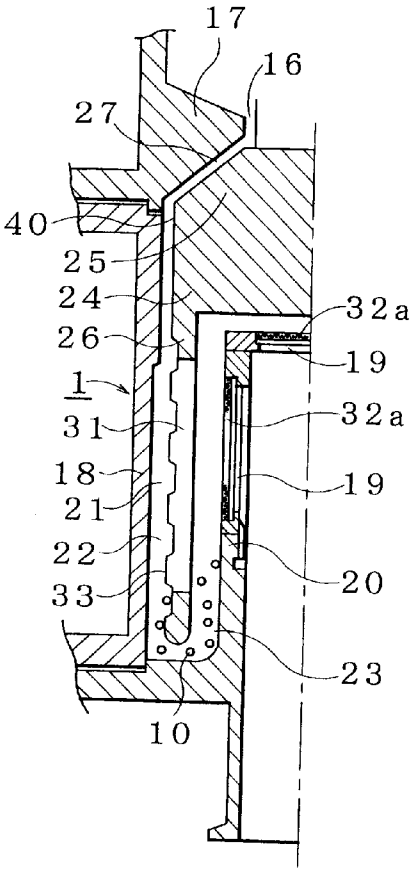

A separating member 32, such as a screen having flow holes such as pores or slits, is disposed at an inner side of the outflow port 19 of the inner stator 20 for separating the dispersion media 10 from the material to be treated. In the embodiment shown in FIG. 1, the separating member 32 comprises a tubular net screen which entirely covers the inner stator 20. In an alternative embodiment, as shown in FIGS. 3(A)–(C), a screen 32*a* may be disposed only at the outflow port 19 of the tubular inner stator 20. In yet another alternative embodiment, a lower inner surface portion of the upper portion 25 of the rotor 24 and an upper end surface portion of the inner stator 20 may be disposed in confronting, spaced-apart relation to one another and formed with various preselected configurations to provide a narrow gap therebetween which prevents passage of the dispersion media 10 through the outflow port 19 of the tubular inner stator 20. It is understood, however, that other types of structures having various constructions and disposed at various locations of the pipeline beads mill are suitable for separating the dispersion media 10 from the material to be treated.

The outer and inner surfaces of the rotor 24, the inner surface of the outer stator 18, and the outer surface of the inner stator 20 which face the treatment gap 21 preferably comprise substantially flat and smooth surfaces. However, if the case requires, in order to control the flow of the dispersion media 10 and the material to be treated when the rotor 24 is rotated, a flow-control surface which is uneven or which has projections, long slots or spiral grooves may be formed on one or more of the outer and inner surfaces of the rotor 24, the inner surface of the outer stator 18, and the outer surface of the inner stator 20 which face the treatment gap 21. For example, flow-control surfaces comprising screw-shaped grooves and spike-like projections are described in U.S. Pat. Nos. 4,856,717 and 4,919,347, respectively, which are incorporated herein by reference.

FIGS. 3(A)–3(C) are cross-sectional views showing embodiments of flow-control surfaces in the form of projections 33 disposed on various surfaces of the rotor 24 and the inner stator 20. The location of the flow-control surface 33 is selected by taking into consideration the properties of the material to be treated and the dispersion effect desired. For example, the flow-control surface 33 may be provided on the outer surface of the rotor 24 (FIG. 3(A)), on the outer surface of the rotor 24 and the outer surface of the inner stator 20 (FIG. 3(B)), or on the outer and inner surfaces of the rotor 24, the inner surface of the outer stator 18 and the outer surface of the inner stator 20 ((FIG. 3(C)).

When the flow-control surface 33 is disposed on the entire outer surface of the rotor 24, the movement of the dispersion medium 10 is accelerated and, accordingly, the amount of the dispersion media 10 flowing toward the inflow port 16 through the conical gap 27 tends to increase. According to the results of experiments, it was confirmed that such tendency can be suppressed by forming a flat and smooth surface 40 at an upper part of the outer surface of the rotor 24 at about 1/7 to about 1/5 of the height of the outer surface, and by forming the flow-control surface 33 at a lower part of the outer surface of the rotor 24 (FIG. 3(A)).

During operation of the pipeline beads mill according to the present invention, the treatment gap 21 is filled with the dispersion media 10 to about 60 to 90% capacity. The material to be treated is then fed into the inflow chamber 9 of the first tubular member 5 through the feeding port 3 from the pipeline L1, enters the outer gap 22 of the treatment gap 21 from the inflow port 16 of the dispersion chamber 2 and then flows into the inner gap 23. The motor (not shown) is then actuated to rotate the rotary drive shaft 14 and the rotor 24. By the rotation of the rotor 24, the dispersion media 10 in the treatment gap 21 is agitated and apply shearing forces to the material to be treated to disintegrate secondary agglomerates in the material to be treated and at the same time finely grind solid particles thereof by impact forces and grinding forces generated among the dispersion media. By this action, the material to be treated is preliminarily dispersed, and only the preliminarily dispersed material is allowed to flow to the discharging port 4 and then through the separating member 32 and the outflow port 19 of the inner stator 20 to the pipeline L2.

A jacket (not shown) may be disposed at an appropriate location around the dispersion chamber 2, the treatment gap 21 or the like, for circulating a temperature-controlling medium to control the temperature during operation of the pipeline beads mill. By this jacket, the temperature inside of the pipeline beads mill may be appropriately adjusted (e.g., to cool or heat the contents) in accordance with the selected material to be treated and parameters for the desired dispersion. The structure of the jacket and the manner of connecting the jacket to the pipeline beads mill are conventionally known in the art and are incorporated herein by reference.

A coating material was used as the material to be treated in a production line dispersing operation test. When the coating material was subjected to pre-treatment in a conventional high-speed stirring machine, the particle size of secondary agglomerates was from about 250 to 350 $\mu$m. In contrast, when the coating material was subjected to pre-treatment using the pipeline beads mill according to the present invention, the particle size of secondary agglomerates was not more than about 50 $\mu$m.

Figure 4:
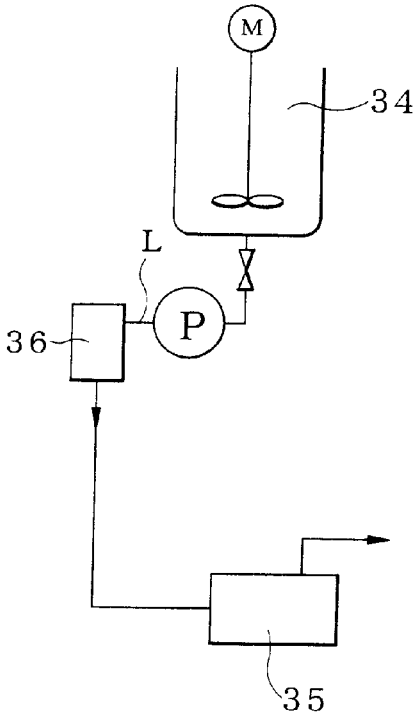
FIGS. 4(A), 4(B) and 4(C) show embodiments of a dispersing system according to the present invention, where
Figure 4:
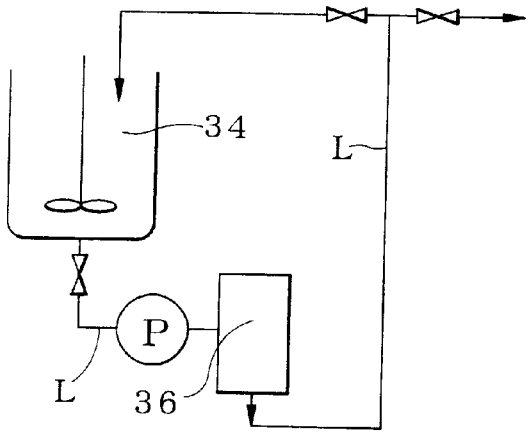
Figure 4:
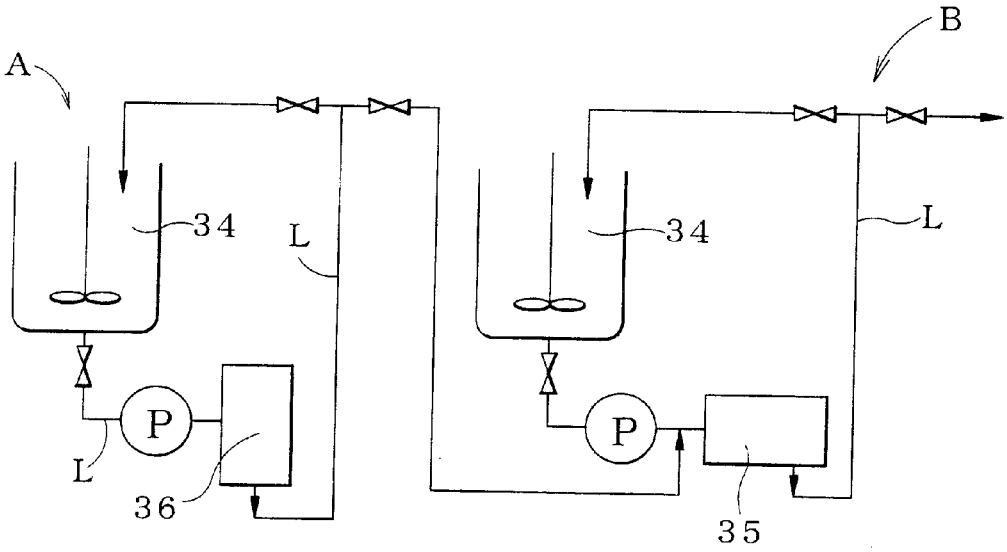

FIGS. 4(A)–4(C) show embodiments of dispersing systems utilizing a pipeline beads mill 36 according to any of the embodiments of the present invention described above with reference to FIGS. 1, 2(A)–2(B) and 3(A)–3(C).

In the embodiment shown in FIG. 4(A), the pipeline beads mill 36 is installed between a stirring tank 34 and a conventional dispersing apparatus 35, such as a wet-type medium-dispersing apparatus, and is utilized to subject the material to be treated to a preliminary dispersion treatment. For example, in a production line for a dispersing operation, the material to be treated is stirred in the stirring tank 34 and is fed to the pipeline beads mill 36 by a pump P for a preliminary dispersion treatment. In the pipeline beads mill 36, agglomerates are disintegrated by preliminary dispersion of the material to be treated. The material to be treated is then fed to the dispersing apparatus 35 and is dispersion-treated to a predetermined degree.

During tests conducted using the dispersing system shown in FIG. 4(A), it was found that as the size of the dispersion media 10 is increased, a more efficient preliminary dispersion of the material to be treated can be carried out using the pipeline beads mill according to the present invention. Namely, it was confirmed through experiments that good results could be obtained by adjusting the size of the dispersion media 10 to be from about 2 to 4 times, and preferably about 3 times, greater than the particle size of the dispersion media used in the dispersing apparatus 35. By adjusting the particle size as described above, substantially the same results could be obtained both in the case where the surfaces of the rotor, the stators and of other members which are exposed to the treatment gap 21 are flat and smooth surfaces, and in the case where such surfaces are uneven or have projections, long slots or spiral grooves formed thereon.

FIG. 4(B) shows an embodiment of a dispersing system in which the pipeline beads mill 36 according to the present invention is utilized as an independent dispersing apparatus (i.e., the system does not require a separate dispersing apparatus, such as a wet-type medium-dispersing apparatus). This dispersing system is preferred when it is desired to subject the material to be treated to simple fine grinding. Thus, in the dispersing system shown in FIG. 4(B), the material to be treated is circulated repeatedly through the stirring tank 34 and the pipeline beads mill 36 via pipeline L and pump P to sufficiently disintegrate agglomerates in the material to be treated. By this construction, the pipeline beads mill 36 according to the present invention may be used as an independent dispersing apparatus.

The embodiment of the dispersing system shown in FIG. 4(C) combines the dispersing system shown in FIG. 4(B) (generally denoted in FIG. 4(C) at A) with another dispersing system containing a second stirring tank 34 and a conventional dispersing apparatus 35 (generally denoted in FIG. 4(C) at B). During operation of the dispersing system shown in FIG. 4(C), the material to be treated is first subjected to a preliminary fine grinding treatment in system A by circulating the material to be treated repeatedly through the stirring tank 34 and the pipeline beads mill 36 via pipeline L and pump P to sufficiently disintegrate agglomerates in the material to be treated. The material to be treated is then subjected to further fine grinding in the dispersing system B by circulating the material to be treated a plurality of times through the stirring tank 34 and the conventional dispersing apparatus 35.

Thus, the pipeline beads mill according to the present invention has a dispersion chamber, a first feeding port for feeding a material to be treated into the dispersion chamber, a second feeding port for feeding a dispersion media into the dispersion chamber, a tubular outer stator disposed in the dispersion chamber, and a tubular inner stator disposed in the outer stator in spaced-apart relation thereto to form a treatment gap therebetween for receiving the dispersion media and the material to be treated. The inner stator has an outflow port in communication with the treatment gap. A tubular rotor is disposed in the dispersion chamber and partitions the treatment gap into an outer gap portion and an inner gap portion . A rotary drive shaft rotates the rotor to agitate dispersion media contained in the treatment gap to exert a shearing force to and thereby disperse the material to be treated. The rotor has a circulation port for permitting circulation of dispersion media between the outer gap portion and the inner gap portion of the treatment gap during rotation of the drive rotor. A discharge port is disposed in communication with the outflow port of the inner stator for discharging the dispersed material. A separating member is disposed at an inner side of the outflow port of the inner stator for separating the dispersion media from the dispersed material and permitting the dispersed material but not the dispersion media to be discharged from the discharge port of the dispersion chamber.

By the foregoing construction, secondary agglomerates present in the material to be treated are sufficiently disintegrated and preliminarily dispersed as the material to be treated is fed through the feeding port and is discharged from the discharge port. As a result, when a preliminary dispersing treatment is carried out using the pipeline beads mill according to the present invention, the power of stirring machines (e.g., stirring tanks) can be reduced and fine grinding using a conventional dispersing apparatus, such as a wet-type medium-dispersing apparatus, can easily be carried out.

Further, when the particle size of the dispersion media used in the present invention is larger than the particle size of the dispersion media of the conventional dispersing apparatus, the secondary agglomerates can be securely disintegrated. Accordingly, it is possible to shorten the dispersion time of the conventional dispersing apparatus, to avoid clogging of the separation member for separating the dispersion media from the material to be treated, to treat the material to be treated uniformly even in the case where fine grinding is not required, and to conduct the dispersion treatment with high efficiency.

Moreover, the pipeline beads mill of the present invention is more compact, conducts a more efficient preliminary dispersing operation, and is better adapted to be readily installed in a dispersing system as compared to conventional batch system pre-treatment machines. Additionally, in the case where simple fine grinding of the material to be treated is desired, the pipeline beads mill of the present invention can be effectively used as an independent dispersing apparatus.

From the foregoing description, it can be seen that the present invention comprises an improved pipeline beads mill and an improved dispersing system having the pipeline beads mill. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

I claim:

1. A pipeline beads mill comprising: a dispersion chamber; a first feeding port for feeding a material to be treated into the dispersion chamber; a second feeding port for feeding a dispersion media into the dispersion chamber; a tubular outer stator disposed in the dispersion chamber; a tubular inner stator disposed in the outer stator in spaced-apart relation thereto to form a treatment gap therebetween for receiving the dispersion media and the material to be treated, the inner stator having an outflow port in communication with the treatment gap; a tubular rotor disposed in the dispersion chamber and partitioning the treatment gap into an outer gap portion and an inner gap portion, the rotor having a generally conical-shaped upper surface portion; a tubular main body having an inwardly projecting portion disposed over and spaced from the upper surface portion of the rotor and forming an inflow port in communication with the dispersion chamber; a rotary drive shaft for rotating the rotor to displace the dispersion media so as to disperse the material to be treated; a discharge port disposed in communication with the outflow port of the inner stator for discharging the dispersed material; and a separating member disposed at an inner side of the outflow port of the inner stator for separating the dispersion media from the dispersed material and permitting the dispersed material but not the dispersion media to be discharged from the discharge port of the dispersion chamber.

2. A pipeline beads mill according to claim 1; wherein the rotor has a circulation port for permitting circulation of dispersion media between the outer gap portion and the inner gap portion of the treatment gap during rotation of the rotor.

3. A pipeline beads mill according to claim 1; further comprising axial flow blades disposed on the rotary drive shaft for generating an axial flow to direct the material to be treated from the first feeding port to the discharge port.

4. A pipeline beads mill according to claim 1; wherein outer and inner surfaces of the rotor, an inner surface of the outer stator and an outer surface of the inner stator are disposed in confronting relation to the treatment gap and comprise generally smooth surfaces.

5. A pipeline beads mill according to claim 1; wherein outer and inner surfaces of the rotor, an inner surface of the outer stator and an outer surface of the inner stator are disposed in confronting relation to the treatment gap; and further comprising a flow-control surface formed on at least one of outer and inner surfaces of the rotor, an inner surface of the outer stator, and an outer surface of the inner stator.

6. A pipeline beads mill according to claim 5; wherein the flow-control surface comprises a non-flat surface.

7. A pipeline beads mill according to claim 5; wherein the flow-control surface comprises a plurality of projections.

8. A pipeline beads mill according to claim 5; wherein the flow-control surface comprises a plurality of spiral grooves.

9. A pipeline beads mill according to claim 1; further comprising a generally conical-shaped gap disposed between the inwardly projecting portion and the upper surface portion of the rotor and in communication wtih the outer gap portion of the treatment gap.

10. A pipeline beads mill according to claim 9; further comprising at least one outflow-preventing projection formed on the upper surface portion of the rotor for preventing the outflow of dispersion media through the inflow port.

11. A pipeline beads mill according to claim 9; further comprising at least one outflow-preventing projection formed on an inner surface of the inwardly projecting portion disposed in confronting relation to the conical-shaped gap for preventing the outflow of dispersion media through the inflow port.

12. A pipeline beads mill comprising: a dispersion chamber; a feeding port for feeding a liquid containing solid particles into the dispersion chamber; a tubular outer stator disposed in the dispersion chamber; a tubular inner stator disposed in the outer stator in spaced-apart relation thereto to form a treatment gap therebetween for receiving dispersion media; a rotor disposed in the dispersion chamber and partitioning the treatment gap into an outer gap portion and an inner gap portion, the rotor having a generally conical-shaped upper surface portion; a tubular main body having an inwardly projecting portion disposed over and spaced from the upper surface portion of the rotor and forming an inflow port in communication with the dispersion chamber; rotating means for rotating the rotor to displace the dispersion media so as to disperse the solid particles in the liquid; means for circulating the dispersion media between the outer gap portion and the inner gap portion of the treatment gap during rotation of the rotor; a discharge port for discharging from the dispersion chamber the liquid containing the dispersed solid particles; and medium-separating means disposed at an inner side of the discharge port for separating the dispersion media from the liquid containing the dispersed solid particles and permitting the liquid containing the dispersed solid particles but not the dispersion media to be discharged from the dispersion chamber.

13. A pipeline beads mill according to claim 12; wherein the rotating means comprises a rotationally driven shaft connected to the rotor; and further comprising a plurality of axial flow blades disposed on the rotationally driven shaft for generating an axial flow to direct the liquid containing the solid particles from the feeding port to the discharge port.

14. A pipeline beads mill according to claim 12; wherein outer and inner surfaces of the rotor, an inner surface of the outer stator and an outer surface of the inner stator are disposed in confronting relation to the treatment gap and comprise generally smooth surfaces.

15. A pipeline beads mill according to claim 12; wherein outer and inner surfaces of the rotor, an inner surface of the outer stator and an outer surface of the inner stator are disposed in confronting relation to the treatment gap; and further comprising a flow-control surface formed on at least one of outer and inner surfaces of the rotor, an inner surface of the outer stator, and an outer surface of the inner stator.

16. A pipeline beads mill according to claim 15; wherein the flow-control surface comprises a non-flat surface.

17. A pipeline beads mill according to claim 15; wherein the flow-control surface comprises a plurality of projections.

18. A pipeline beads mill according to claim 15; wherein the flow-control surface comprises a plurality of spiral grooves.

19. A pipeline beads mill according to claim 12; further comprising a generally conical-shaped gap disposed between the inwardly projecting portion and the upper surface portion of the rotor and in communication with the outer gap portion of the treatment gap.

20. A pipeline beads mill according to claim 19; further comprising at least one outflow-preventing projection formed on the upper surface portion of the rotor for preventing the outflow of dispersion media through the inflow port.

21. A pipeline beads mill according to claim 19; further comprising at least one outflow-preventing projection formed on an inner surface of the inwardly projecting portion disposed in confronting relation to the conical-shaped gap for preventing the outflow of dispersion media through the inflow port.

22. A pipeline beads mill according to claim 12; further comprising a main body comprised of a first tubular member having the feeding port and an inflow chamber for receiving the liquid containing solid particles fed through the feeding port, a third tubular member having the discharge port, and a second tubular member disposed between the first and third tubular members and having the dispersion chamber.

23. A pipeline beads mill according to claim 22; wherein the first tubular member has a second feeding port for feeding dispersion media into the treatment gap.

24. A dispersing system comprising: a dispersing apparatus for dispersing solid particles in a liquid containing the solid particles by displacing dispersion media disposed in a dispersion chamber and in contact with the liquid containing the solid particles; and a pipeline beads mill containing dispersion media for preliminarily dispersing the solid particles in the liquid prior to dispersion of the solid particles in the liquid by the dispersing apparatus.

25. A dispersing system according to claim 24; wherein the dispersing apparatus comprises a wet-type medium-dispersing apparatus.

26. A dispersing system according to claim 25; wherein a particle size of the dispersion media contained in a treatment gap of the pipeline beads mill is from 2 to 4 times greater than a particle size of the dispersion media used in the wet-type medium-dispersing apparatus.

27. A dispersing system according to claim 24; wherein a particle size of the dispersion media contained in a treatment gap of the pipeline beads mill is from 2 to 4 times greater than a particle size of the dispersion media used in the dispersing apparatus.

* * * * *